US005358082A

United States Patent [19]

Armstrong, IV

[11] Patent Number: 5,358,082

[45] Date of Patent: Oct. 25, 1994

[54] EXPANDABLE LUGGAGE COMBINING HARDSIDE AND SOFTSIDE MATERIALS

[76] Inventor: James E. Armstrong, IV, 2205 Solmar Dr., Silver Spring, Md. 20904

[21] Appl. No.: 149,918

[22] Filed: Nov. 10, 1993

[51] Int. Cl.[5] ..... A45C 7/00

[52] U.S. Cl. ..... 190/21; 190/24; 190/127

[58] Field of Search ..... 190/103, 18 A, 21, 124, 190/127, 24

[56] References Cited

U.S. PATENT DOCUMENTS

| | | | |
|---|---|---|---|
| 598,095 | 2/1898 | Hutchinson . | |
| 698,488 | 4/1902 | Gilbert . | |
| 1,521,310 | 12/1924 | Moran | 190/21 X |
| 1,806,246 | 5/1931 | Feldman et al. . | |
| 1,950,118 | 3/1934 | Lifton . | |
| 2,107,828 | 2/1938 | Krantz | 190/21 X |
| 2,290,090 | 7/1942 | Bracken . | |
| 2,536,169 | 1/1951 | Gray . | |
| 2,752,018 | 6/1956 | Arlitt, Jr. | 190/21 |
| 2,875,868 | 3/1959 | Powell . | |
| 3,443,671 | 5/1969 | Dyke . | |
| 3,925,931 | 2/1976 | Kaplan et al. | 190/21 |
| 4,008,790 | 2/1977 | Eiteljorg, II | 190/103 X |
| 4,321,727 | 3/1982 | Sheiman et al. | 190/18 A X |
| 4,448,292 | 5/1984 | Comfort . | |
| 4,503,955 | 3/1985 | Fitzsimmons, Jr. . | |
| 4,773,515 | 9/1988 | Kotkins, Jr. | 190/103 |
| 4,781,278 | 11/1988 | Sadow . | |
| 4,813,520 | 3/1989 | Lin . | |
| 4,895,230 | 1/1990 | King | 190/103 X |
| 5,228,546 | 7/1993 | Chang et al. | 190/103 X |

FOREIGN PATENT DOCUMENTS

| | | | |
|---|---|---|---|
| 575872 | 4/1958 | Italy | 190/21 |

*Primary Examiner*—Allan N. Shoap
*Assistant Examiner*—Christopher McDonald
*Attorney, Agent, or Firm*—Armstrong, Westerman, Hattori, McLeland & Naughton

[57] ABSTRACT

An expandable article of luggage of softside and hardside material construction, consisting of a top section, a bottom section, and a center section that can be added or removed readily for different luggage capacities, is constructed of a design such that the luggage expands like softside luggage when overfilled, but retains its frame shape like hardside luggage. Its design also allows for a center section that may be collapsed and folded and inserted in the unexpanded luggage. In addition, the material combination allows for an improved wheel construction, consisting of large disk shaped wheels mounted in wheel wells at the base of the luggage.

6 Claims, 7 Drawing Sheets

EXPANDABLE LUGGAGE COMBINING HARDSIDE AND SOFTSIDE MATERIALS

FIELD OF INVENTION

This invention relates to carrying cases, such as suitcases, and to improvements therein by making such carrying cases expandable and by uniquely combining softside and hardside luggage materials in their construction.

BACKGROUND

Often, today's travel is multi-purpose. The travel intent of most travelers is varied and, often, unanticipated. For example, a traveler, once travel has started, might need additional packing space for gifts or purchases. In this predicament, the traveler often is forced to buy additional luggage, which often is awkward and cumbersome to carry. In a different situation, a traveler might need a smaller luggage case for a short trip, such as a weekend trip. This requires the traveler to have multiple articles of luggage, of varying sizes, to avoid using a cumbersome oversized case for a small side trip. It is for these reasons that expandable and contractible luggage, better to fulfill the needs of the traveler, have been developed.

Conventional, one piece baggage or luggage, like a suitcase, is typically grouped into two material-types: hardside and softside luggage. Expandable luggage is grouped, based on the mechanism of the expandable function, into three sets: telescoping articles, modular or sectioned articles, and accordion type articles. In addition to material and expandable categories, the prior art includes different combinations thereof.

In attempting to overcome the shortcomings of single piece luggage, proposals in the past for expandable luggage have limitations. Modular expanding cases have been developed to overcome restraints of previous telescoping and accordion type cases. Such limitations are exemplified in the telescoping bags, such as described in U.S. Pat. No. 598,095 (1898) requiring one or more overlapping sections, including a lid and additional mid-section over-lapping a bottom piece. Such sections are made of stiff material and must all be carried, with the telescoping bag, whether it is expanded or not. This adds to the weight and bulkiness of the bag. Accordion type cases work on the principle of expanding and contracting overlapping folds of material or pleats similar to those in an accordion. This, again, has the limitation of the additional weight and bulkiness the pleats create, especially when the pleats are in the unused, collapsed position. Also, the accordion construction requires that straps, or other restraints, must be used to hold the pleats closed and is exemplified in the hand baggage of U.S. Pat. No. 1,806,246 (1931) .

Modular cases, in the prior art, all have limitations. Most modular cases are fabricated of components that are made entirely of either flexible or stiff material. U.S. Pat. No. 4,503,955 (1985) describes a modular carrying case of all metal construction with a top and bottom section and one or more interlocking center sections for additional capacity. A user is disadvantaged by the weight of the modular carrying case and its awkward center sections. In U.S. Pat. No. 1,950,118 (1934) the sides of the stiff interlocking mid-sections are collapsible. These collapsible mid-sections are for the purpose of storage and shipping and not necessarily designed such that the mid-sections may be carried inside the luggage and used later, if necessary. Because the sections of the valise are made of leather with a hardened background of cardboard, the case is subject to the limitations of conventional hardside luggage. In U.S. Pat. No. 3,443,671 (1969) a modular case is composed mainly of flexible fabric. Instead of interlocking parts, the expandable carrying case uses slide fasteners, namely zippers, to connect the pieces. This provides for the expandable sections to remain attached to the main body of the case and the sections are expanded by a unique slide fastener arrangement. However, the carrying case is mainly made of fabric and, thus, subject to the limitations of conventional softside cases.

The following two articles of travel luggage are designed as a combination of hardside and softside materials but both are subject to their own design restraints. In U.S. Pat. No. 4,813,520 (1989) a collapsible piece of baggage, comprises externally of a flexible or pliable material and externally of a detachable frame outlining the bag's shape. Such bag is designed to be reduced in size only for storage purposes. The frame is made inefficient by the many small pieces and screws necessary for assembly. The "Simulated Hard Frame Luggage" in U.S. Pat. No. 4,781,278 (1988) is structurally weakened by its only partial hard frame sections in the corners of the luggage, and thus, does not pose the strength attributed to a solid hardside luggage case.

SUMMARY OF THE INVENTION

Objects and Advantages

It is the object of this invention to provide an article of luggage that is expandable, such that it anticipates an owner's needs for capacity, and uniquely combines both hardside and softside luggage materials in a package of comparable weight to completely hardside luggage cases. The several objects and advantages of the present invention are, among others:

(a) to provide a travel case that is durable as hardside luggage under normal airline or handling abuse;
(b) to provide a travel case that retains its shape as hardside luggage;
(c) to provide a travel case that expands when overfilled as softside luggage;
(d) to provide a travel case of comparable weight to typical hardside luggage;
(e) to provide a travel case having a modular expansion leaf that can be added for larger interior capacity or removed for smaller capacity;
(f) to provide a travel case with a modular expansion leaf that is easy to use and fits securely into place;
(g) to provide a travel case with a modular expansion leaf that is collapsible, so as to be carried inside the unexpanded case for possible later use;
(h) to provide a travel case with a modular expansion leaf that is easy and inexpensive to fabricate;
(i) to provide a travel case that can incorporate the amenities of a hardside case, such as a durable retractable handle and durable wheels;
(j) to provide a travel case with wheels that stabilize the case when rolled over rough surfaces;
(k) to provide a travel case with wheels partially enclosed within the body of the case so as to not be ripped off or broken under airline or handling abuse;
(l) to provide a travel case that is attractive and uncluttered in appearance;

(m) to provide a travel case with a minimum number of moving parts.

Further objects and advantages are to provide an expandable article of travel luggage that has variable interior capacity and an attractive and functional combination of hardside and softside luggage materials. Additional objects and advantages will become apparent from a consideration of the drawings and ensuing description.

DRAWING FIGURES

In the drawings, the closely related figures have the same number but different alphabetic suffixes.

DESCRIPTION OF FIGS. 1-3, 5, 6A, 7A, 7B, 9

Figure 1:
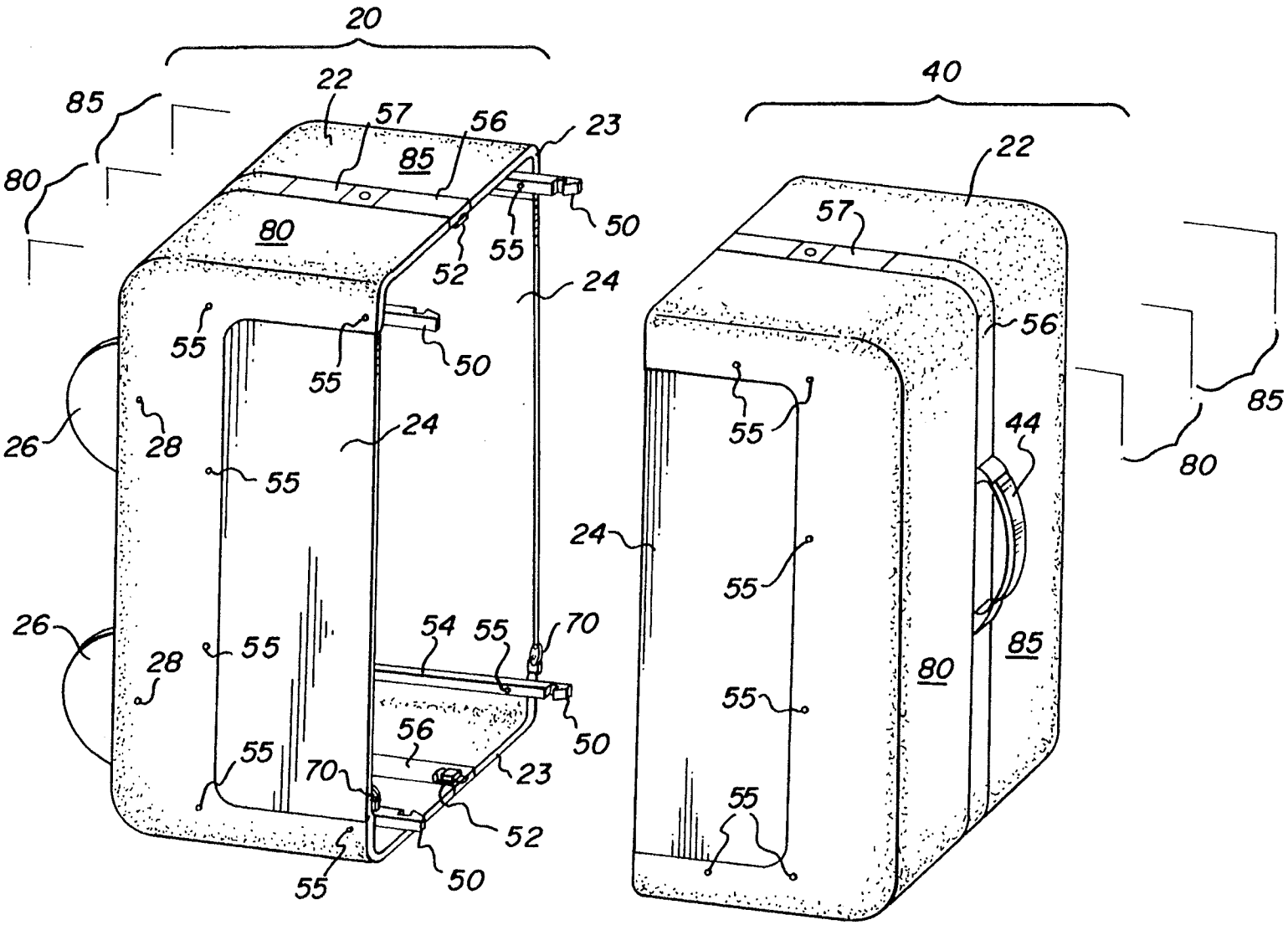
FIG. 1 shows a perspective of a top and a bottom section of the expandable luggage, on its side without the center expansion leaf.
Figure 2:
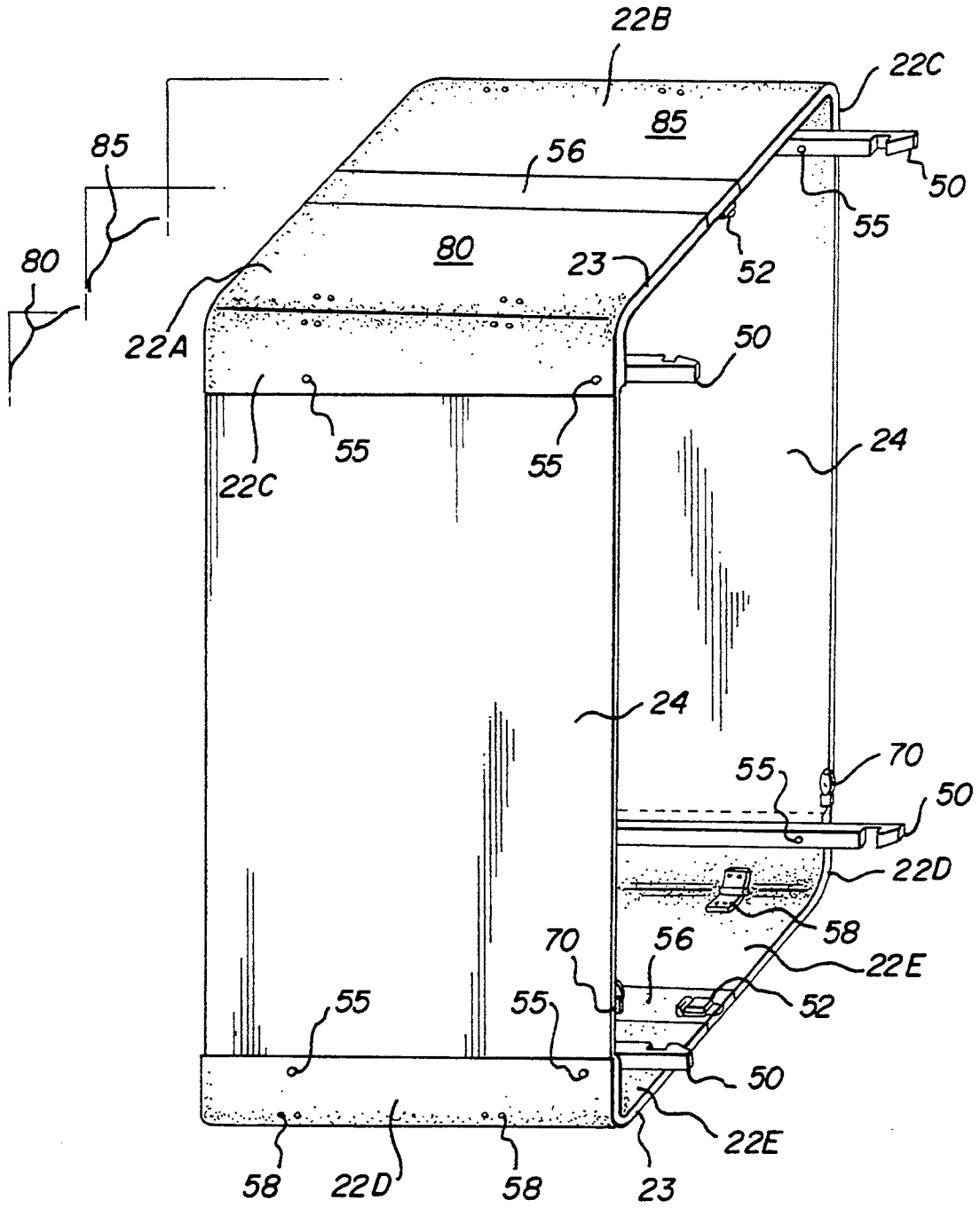
FIG. 2 shows a perspective drawing of a center expansion leaf on its side for use with the top and bottom sections of FIG. 1.

A typical embodiment of the expandable luggage in the present invention is illustrated in FIG. 1 with an expansion leaf 30 shown in FIG. 2. The luggage of this embodiment is comprised of three sections: a bottom section 20, expansion leaf 30, and a top section 40. As shown in FIG. 1, the construction of the expandable luggage of this embodiment involves the combination of three main materials, namely, a molded hardside frame 22, a rigid inner frame 56, and a flexible fabric 24. All three sections are fashioned of expandable soft fabric 24 attached to molded hardside frame 22, in turn, attached to inner frame 56. In the preferred embodiment, fabric 24 is a material designed to accommodate stretching and resist puncture by blunt objects, typically a tear resistant nylon, like woven ballistic nylon or woven polyester. However, the following common textile materials may also be employed: nylon 6, nylon 66, vinyl, other synthetic fibrous materials, leather, cloth or any other suitable sheet material which is flexible or pliable or which can be folded. In the preferred embodiment, molded hardside frame 22 is fabricated of material with the following properties: high impact strength, excellent injection or vacuum molding behavior, low mold shrinkage, excellent surface finish, and an economical price. Typically, the desired material is acrylonitrile-butadiene-styrene (ABS) plastic, but other materials include the following: high impact polystyrene (HIPS), other styrene copolymers including blends of polystyrene and poly(phenylene oxide) (PPO), vinyl chloride plastics including poly(vinyl chloride)(PVC), cellulose plastics, polycarbonate plastics, polypropylene (PP) plastics including impact modified PP, polyolefin plastics including high density polypropylene (HDPE), polyamide plastics, fluoroplastics including polytetrafluoroethylene (PTFE), resin and glass fiber reinforced plastics encompassing dough molding compounds (DMC), other plasticized and non-plasticized materials that are easily molded or shaped accordingly. Referring to the external appearance of the expandable luggage in FIG. 1, the edges of molded frame 22 are all slightly rounded. The rounded edges provide for a trim luggage case without any protruding sharp points or angles. Inner frame 56, in the preferred embodiment, is a durable lightweight metal such as magnesium, however other materials like aluminum, lightweight steel, steel composites and other metals or metal composites may be used.

The rough dimensions of the preferred embodiment are 75 cm (including expansion leaf 30, but excluding wheels 26) tall X 50 cm wide X 20 cm deep. Expansion leaf 30 alone, as seen in FIG. 2, is roughly 25 cm tall X 50 cm wide X 20 cm deep. The expandable luggage, however, is not limited to the aforementioned specific sizes or even to the preferred rectangular shape. As shown in FIG. 1, inner frame 56 forms the junction between a lid top 80 and a lid bottom 85 of the expandable luggage. Inner frame 56 is divided lengthwise into two unequal parts, with the larger, wider part attached to molded frame 22 of lid bottom 85 and the smaller part attached to molded frame 22 of lid top 80. The two parts of inner frame 56 are connected to each other by three hinges 53 located at points shown in FIG. 3. A handle 44 and two opening and closing latches 57, located in positions shown in FIG. 1, are anchored to the larger half of inner frame 56 connected to lid bottom 85. Handle 44 and two opening and closing latches 57 are attached to inner frame 56 by having parts common with the frame. The function and mechanics of lid latches 57 and handle 44 are common knowledge to any one skilled in the art and are simplified here. Handle 44 illustrated in FIG. 1 is the simplest type baggage handle. In the preferred embodiment, however, a retractable handle (not illustrated) could be built into the top of inner frame 56.

Figure 3:
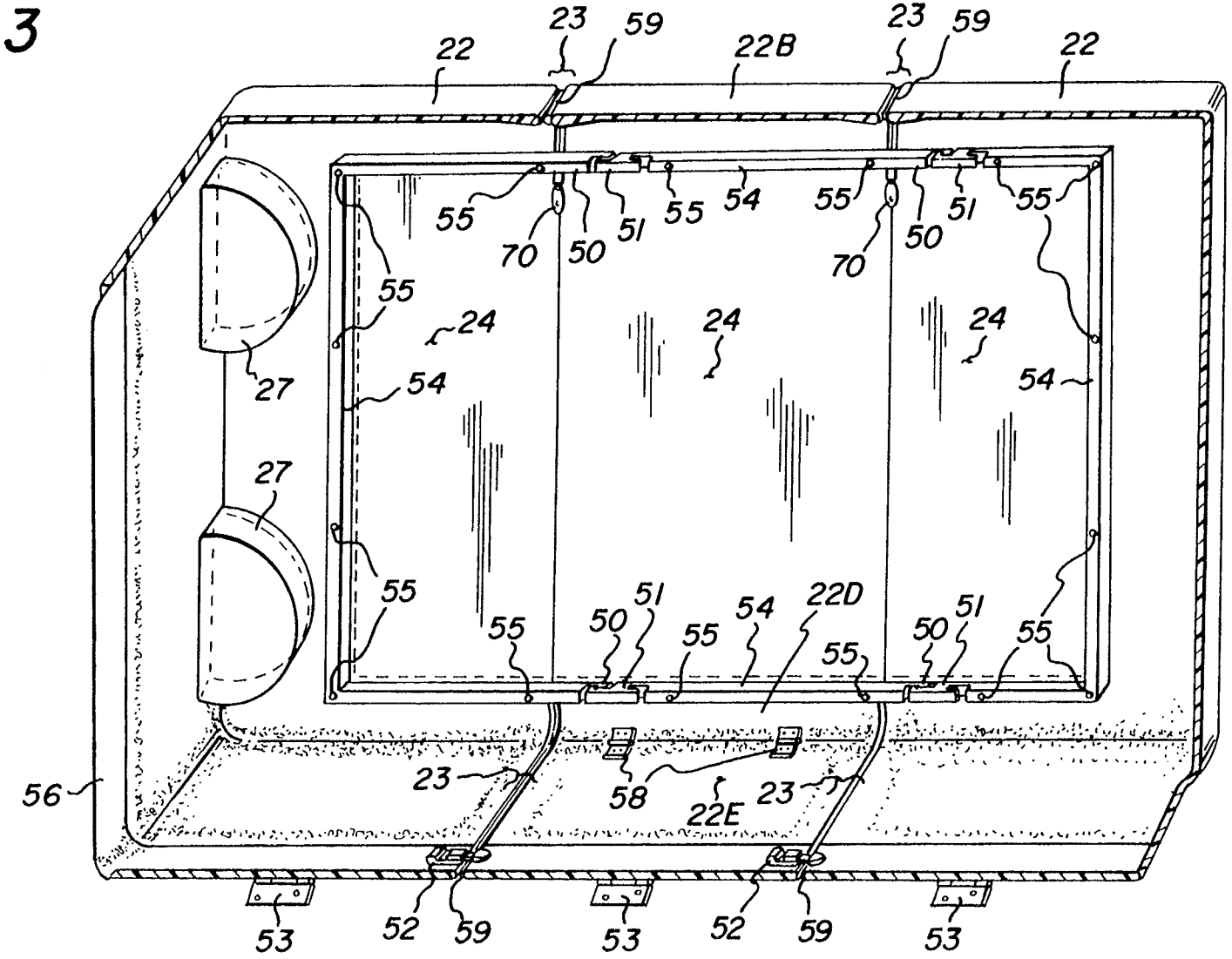
FIG. 3 shows a cross-section perspective view of the expandable luggage, on its side with the center expansion leaf in place.

FIG. 3 best illustrates the union of the three materials in the construction of the expandable luggage. Fabric 24 is anchored to molded frame 22 by an adhesive substance, like glue for example, applied to the respective edges of fabric 24. Each edge, that is to be attached to molded frame 22, is sandwiched in-between a strip 54, made of the same preferred material as the molded hardside frame or any of the other aforementioned molded hardside materials. Strip 54 is joined to molded frame 22 with rivets or bolts 55. The number and positions of bolts 55 are indicated in FIG. 3. A slide fastener 70, FIG. 1, one type commonly known as a zipper, is attached to both sheets of fabric 24 on bottom section 20.

Figure 7A:
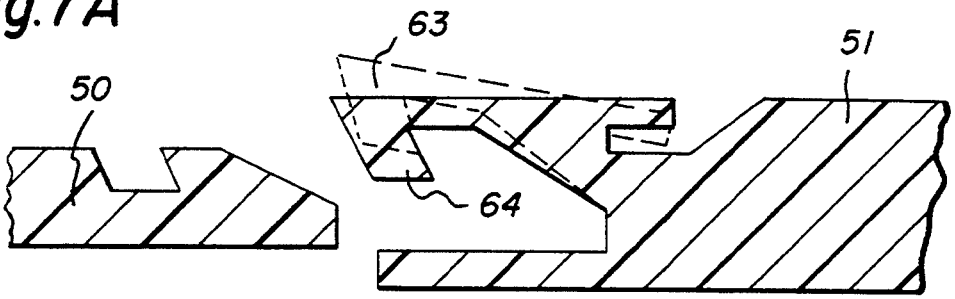
FIG. 7A shows a cross-section of a male-female interconnecting lock used to connect the top and bottom and expansion parts.

The two ends of each strip 54 on bottom section 20 are molded to the shape of a male end 50 of an interconnecting lock. The two ends of each strip 54 on top section 40, FIG. 3, are molded to the shape of a female end 51 of an interconnecting lock. FIG. 7A shows a cross-section of the preferred embodiment of male end 50 and female end 51 of the interconnecting lock. FIG.

Figure 7B:
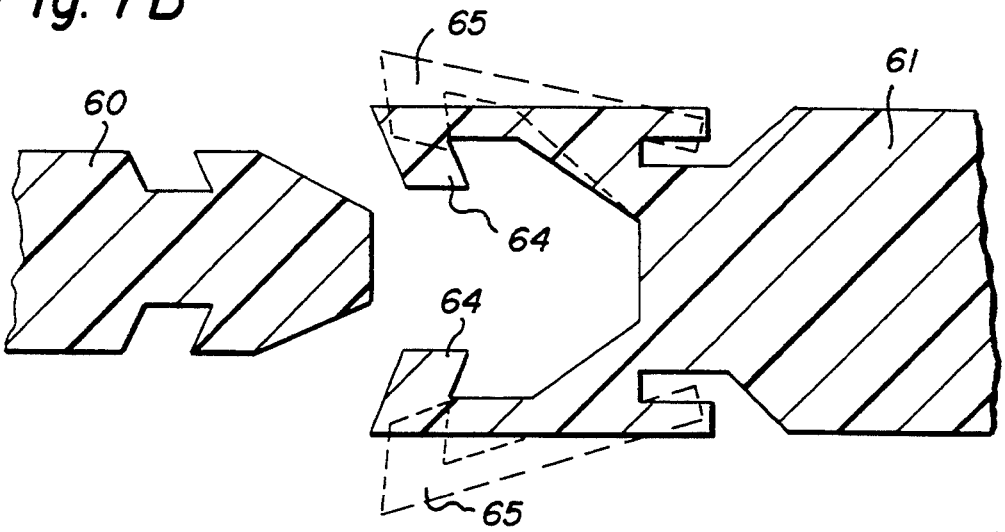
FIG. 7B shows a cross-section of an additional embodiment of 7A.

7B shows another embodiment of a male end 60 and a female end 61 of the interconnecting lock. The interconnecting lock embodiments are not limited to those illustrated in FIGS. 7A and 7B, and may include other male-female lock design configurations. Opposite ends of each strip 54 on expansion leaf 30 are molded to the respective male end 50 or female end 51 of the interconnecting lock.

The positions of the male-female interconnecting locks on strip 54 on the expandable luggage are designed to minimize the number of locks necessary to sturdy the luggage under normal airline abuse. It is intended that the locks ensure a tight fit for the parts of the expandable luggage. The tight construction will protect the luggage from damage by the force of a fall or a kick. Also included to secure the luggage, are latches 52, illustrated in FIG. 1 and FIG. 3, that are designed to lock the parts of inner frame 56 on the top, bottom, and center section together. Latches 52 are located on the inside of inner frame 56 on both sides of each section of luggage.

Figure 6A:
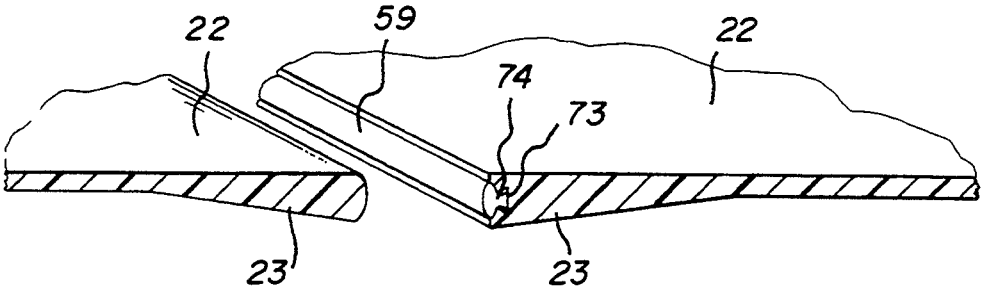
FIG. 6A and 6B show a cross-section of a luggage joint.
Figure 6B:
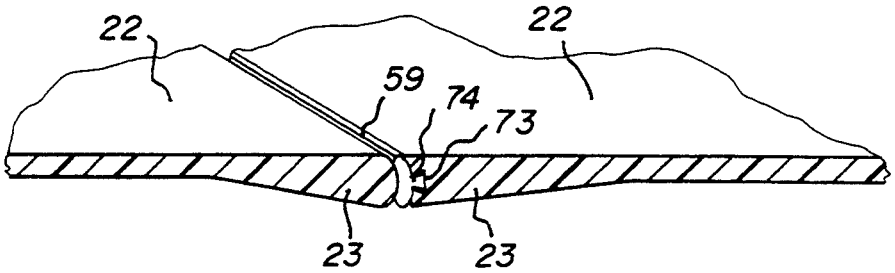

Molded frame 22 is typically shrunk to fit inner frame 56 by means of technology known to those skilled in the art. The thickness of the preferred embodiment of molded frame 22 is approximately 2 mm to 3 mm thick increasing to 5 mm to 7 mm at a connection joint 23. However, molded frame 22 thicknesses are not restricted to those mentioned here. Connection joint 23 extends the length of the perimeter of molded frame 22 and inner frame 56, on each of the three sections of the expandable luggage, that come in contact with the respective perimeter of another section. FIG. 6A illustrates the relative thickness of molded frame 22 near and away from connection joint 23. The shape of connection joint 23 is such that one half is convex and the other fitted half is concave. Lining the concave half of connection joint 23 is a gasket 59. Gasket 59 is attached to the concave half of connection joint 23 by the insertion of a gasket ridge 74 into a gasket notch 73, as shown in FIG. 6A.

Molded frame 22 of expansion leaf 30 is divided into 8 sections and is best shown in FIG. 2. Molded section 22 A of lid top 80 and molded section 22B of lid bottom 85 are each connected to separate molded sections 22C by locking hinges 58 located at two points along each joint. Likewise, molded section 22E of lid top 80 and lid bottom 85 are each connected to separate molded sections 22D by locking hinges 58 located at two points along each joint. FIG. 3 shows the positioning of hinges 58 along one of the joints of expansion leaf 30. Slide fastener 70, is attached along one side of each sheet of fabric 24 on expansion leaf 30 as seen in FIG. 2. Four imbedded wheels 26 are attached to bottom section 20. In the preferred embodiment, wheels 26, shaped like disks, are fabricated of ABS plastic. However, other material, including, but not limited to, the aforementioned plastics listed with respect to frame 22 could be used. FIG. 1 shows a perspective drawing of two wheels 26, while the cross-section FIG. 3 depicts two wheel wells 27 inside bottom section 20. The position of wheel wells 27 and wheels 26 are best illustrated in cross-section FIG. 5. A close perspective of wheel 26 construction is diagrammed in a cross-section in FIG. 9. In the preferred embodiment, wheel 26 is roughly 12 cm tall and 2.1 cm thick at the mid-section. Wheel 26 rotates about an axis, such as axle/bolt 28. In the preferred embodiment at least 3/5's of wheel 26 is imbedded in bottom section 20 of the expandable luggage. Additional embodiments (not shown) could have a similar wheel construction with wheels 26 mounted in wheel wells 27, however wheels 26 could be exposed. Thus the entire wheel 26 would be showing, but still mounted on wheel axle 28 driven through wheel 26 and shored at other side of wheel well 27. Molded frame 22 is thickest at the point between wheel well 27 and the outside of the outer edge of molded frame 22. Molded strip 54 runs just above wheel well 27. In the preferred construction, bolt 28 and/or the axle hole of wheel 26 would be coasted with PTFE or some other inexpensive friction reducing material.

OPERATION-FIGURES 1–10

In the preferred embodiment, the expandable luggage has two sizes. The attachment of top section 40 to bottom section 20, both illustrated in FIG. 1, makes a functional piece of luggage about 54 cm tall including wheels 26. The sections are attached in the following manner: first, top section 40 is pressed firmly against bottom section 20 with male ends 50 of the interconnecting locks on bottom section 20 aligned with female ends 51 of the interconnecting locks on top section 40. The lock design allows for male ends 50 of the interconnecting locks to fit snugly into female ends 51 of the interconnecting locks by simply pressing the two end parts together. As illustrated in FIG. 7A, latch 64 on female end 51 of the interconnecting lock raises to an expanded position 63, allowed by the flexibility of the material. Latch 64 returns to its natural non-flexed position after male end 50 of the interconnecting lock is inside female end 51 of the interconnecting lock. The joining of the male-female ends compresses gasket 59 that runs between molded frame 22 of top section 40 and bottom section 20. Gasket 59 provides for a tight fit around molded frame 22 even as male ends 50 and female ends 51 of the interconnecting locks wear and perhaps loosen. Once the interconnecting locks are tight, the expandable luggage can be opened by unlocking latches 57 and pulling lid top 80 open. From the inside, frame latches 52 on both sides of the frame are locked to secure the parts of inner frame 56 on top section 40 and bottom section 20 together. Next, fabric 24 is connected to its counterpart by means of slide fastener 70 on both sides of the luggage. After the above assembling, the expandable luggage is in its usable unexpanded form. To disassemble the luggage, the above method is reversed. To unlock the interconnecting lock, the back end of latch 64 is depressed in order to release the male and female ends of strips 54. To expand the luggage capacity, expansion leaf 30, diagrammed in FIG. 2, is inserted and the aforementioned assembling process is repeated. Latches 52 are the same on expansion leaf 30 as on top section 40 and bottom section 20. A cross-section of the expandable luggage in its usable expanded form is detailed in FIG. 3. The addition of expansion leaf 30 in-between top section 40 and bottom section 20 expands the luggage to approximately 79 cm tall including wheels 26.

Figure 4:
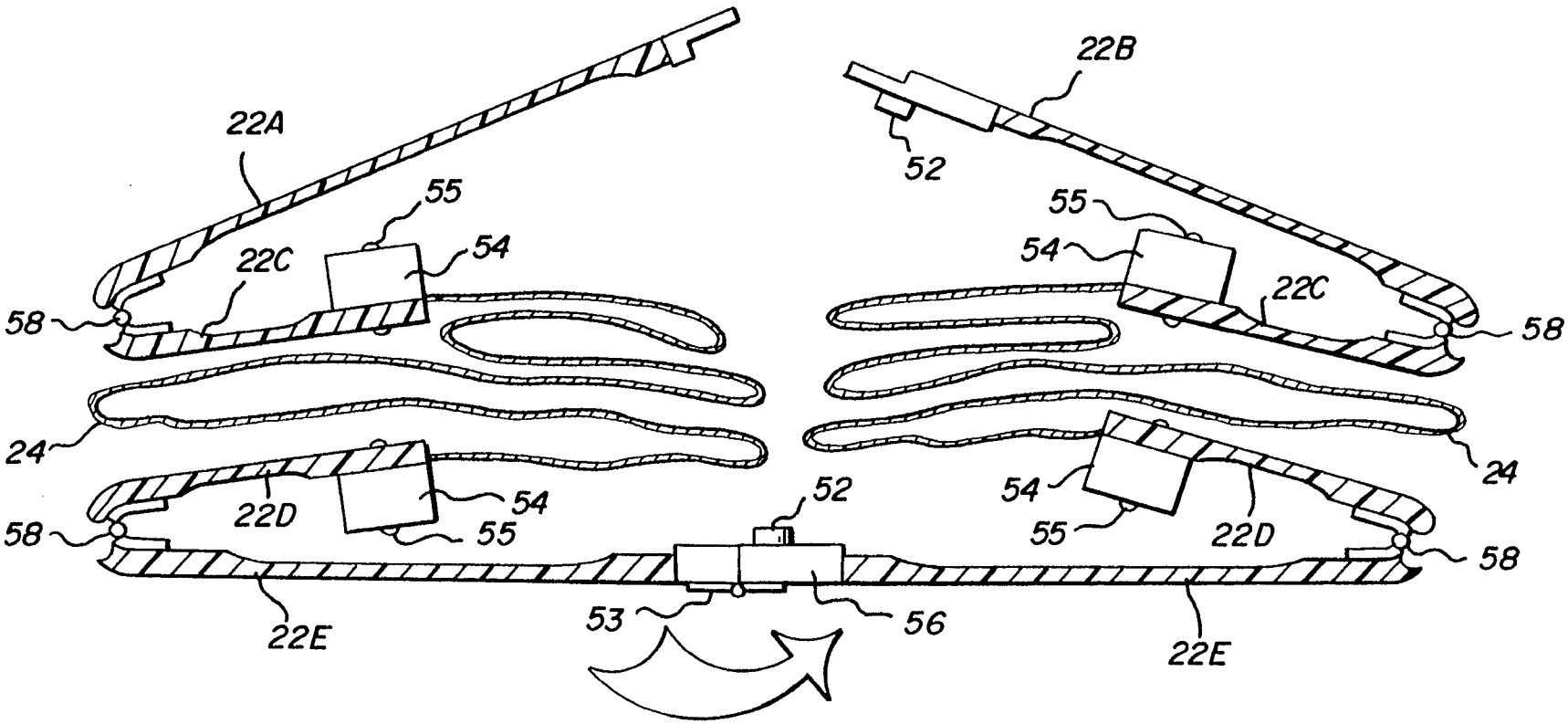
FIG. 4 shows a cross-section of an expansion leaf in its collapsed state.
Figure 8A:
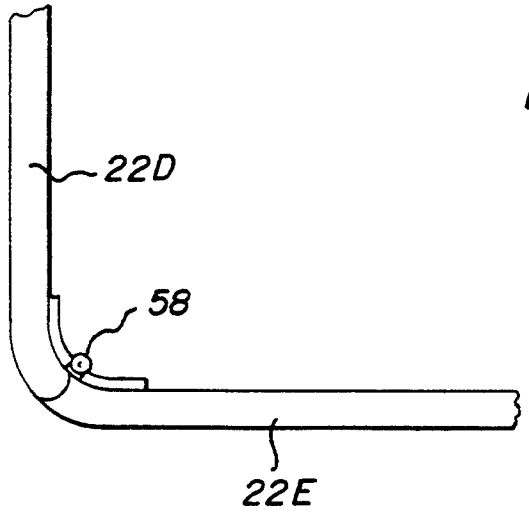
FIG. 8A and 8B show a cross-section of a hinged joint on a corner of an expansion leaf which provides for the leaf's collapsibility.
Figure 8B:
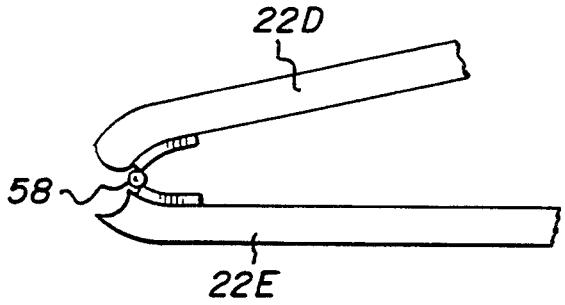

The feature that makes the expandable luggage functional is the fact that expansion leaf 30 can be collapsed and carried inside the luggage piece in its unexpanded state. FIG. 4 details hinge 58 points of expansion leaf 30. Expansion leaf 30 can be collapsed as shown in FIG. 4 and it can be folded once more as indicated by the arrow. Hinges 58 at different points on expansion leaf 30 are locking hinges. When expansion leaf 30 is opened from its collapsed state, hinges 58 lock in the open position, as sketched in FIG. 8A, so molded frame 22 conforms to its designed shape. Hinges 58 can easily be unlocked in order to return expansion leaf 30 to its collapsed state in FIG. 4.

Figure 5:
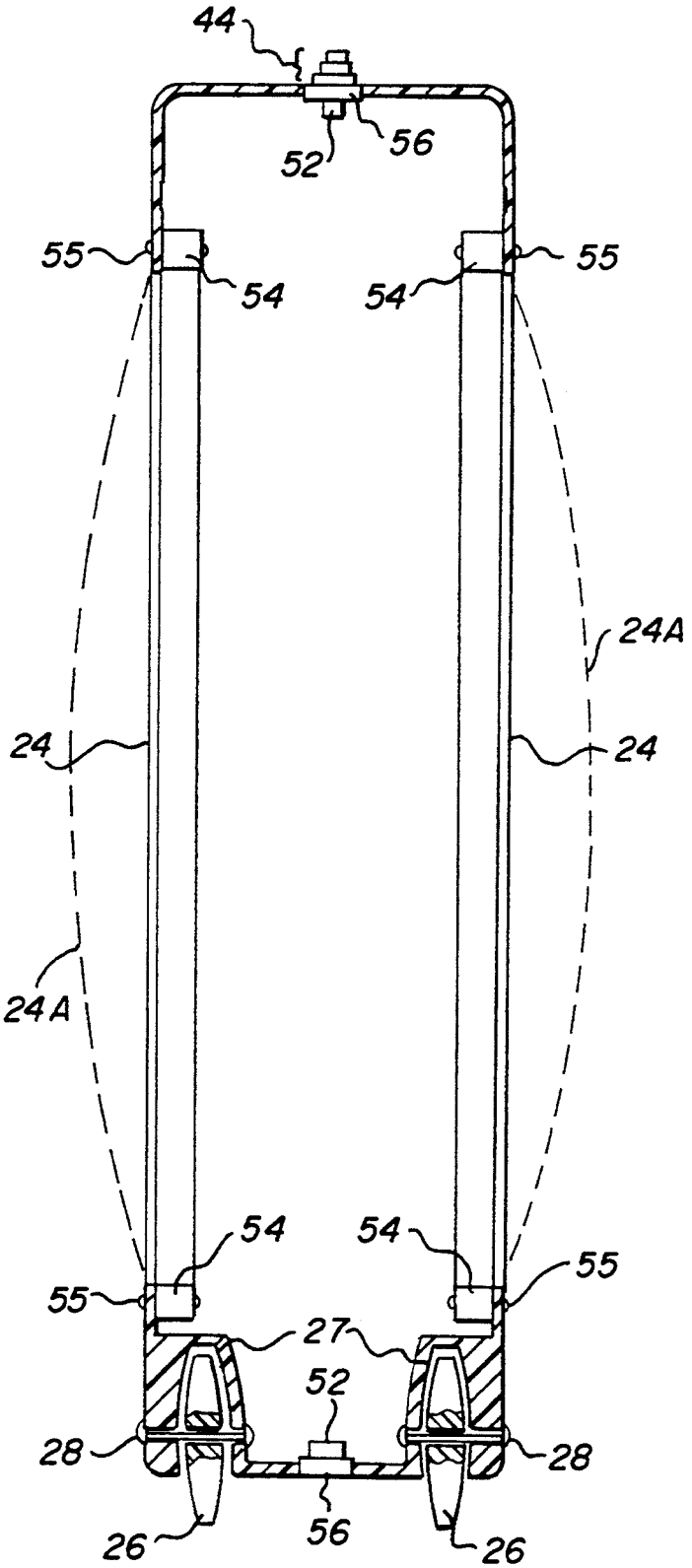
FIG. 5 shows a cross-section of the expandable luggage in its upright position.
Figure 9:
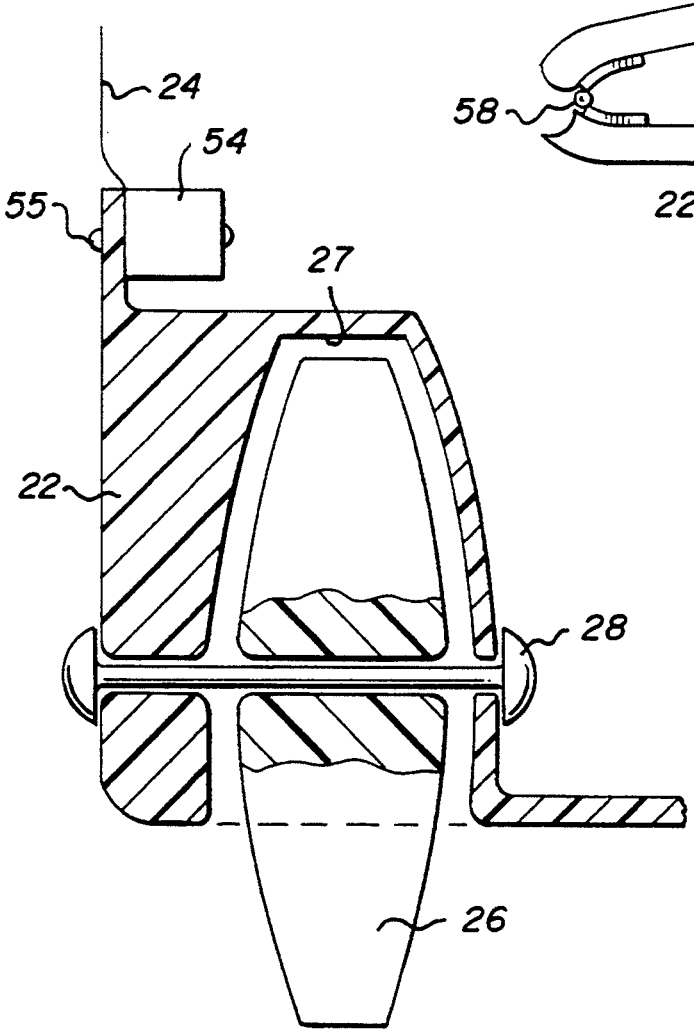
FIG. 9 shows a cross-section of an imbedded wheel.

Overcoming the limitations of a completely hardside design, means having the capability to allow for luggage overstuffing. This is depicted in FIG. 5. Fabric 24 can expand to a maximum position 24A when the luggage is overfilled. However, fabric 24 is stiff enough not to expand when the luggage is slightly underfilled. The design of wheel 26 is illustrated in FIG. 9. Axle 28 allows for the free rotation of wheel 26 in wheel well 27. Larger disk shaped wheels 26 are an improvement over the conventional small spherical wheels because the luggage acts as its own cart, instead of a case with limited rolling capacity. Axile 28 is made stationary by its tight fit in molded frame 22 and the rounded anchor ends.

Figure 10:
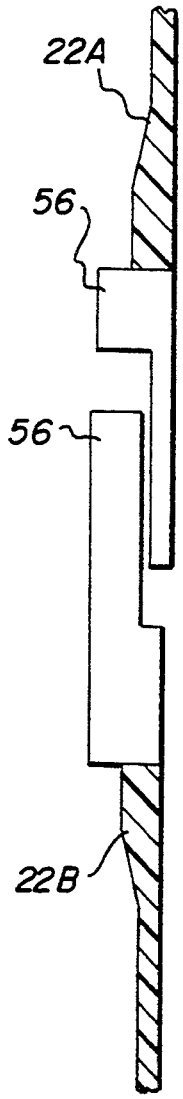
FIG. 10 shows a cross-section view of a frame section that forms an opening to the luggage.

Finally, FIG. 10 illustrates the fitting of luggage lid top 80 onto luggage lid bottom 85. The exact construction of inner frame 56 and its division along lid top 80 and lid bottom 85 is known to those skilled in the art and will not be described here.

The expandable luggage of this invention is made functional by its unique arrangement of hardside and softside luggage material and its capacity for expansion. Because today's travel is often multi-purpose, luggage needs to be specifically created to better serve the owner, instead of the traveler being restrained by the limits of the luggage. The expandable luggage combines the advantages of hardside, softside, and modular luggage in one complete package. Furthermore the expandable luggage has the additional advantages in that:

- it provides a travel case with a hardside molded frame that is more durable than softside luggage and can act as a housing to which typical hardside luggage amenities are attached like: a retractable handle, a combination lock, and larger wheels;
- it provides a travel case with parts that can be easily and inexpensively molded or extruded;
- it provides a travel case with a softside expandable midsection that allows for generous overstuffing;
- it provides a travel case with an expansion leaf that can be added for more capacity or removed to accommodate a small trip;
- it provides a travel case with an expansion leaf that is itself collapsible, such that it may be carried within the unexpanded luggage and used later if needed;
- it provides a travel case with an expansion leaf that is lightweight and compact when collapsed; and
- it provides a travel case that is of comparable weight and cost to similar sized hardside articles of luggage on the market.

Although the description above contains many specifities, these should not be construed as limiting the scope of the invention but as merely providing illustrations of some of the presently preferred embodiments of this invention. For example, the expandable luggage and its expansion leaf can be of different sizes than those mentioned; the expandable luggage with its expansion leaf could be of different shapes such as square, trapezoidal, circular, etc.; the latches and interconnecting locks may have other shapes or configurations; the attachment bolts could be substituted for rivets, tacks, pins, etc.

Thus the scope of the invention should be determined by the appended claims and their legal equivalents, rather than the examples given.

I claim:

1. An article of luggage for travelling comprising:

(a) a support frame having edges, corners, and small sides formed from a hard durable material and attached to a harder more durable inner frame with mid-section sides of a flexible compliant material between said support frame and secured between said hard, durable material and said harder more durable inner frame and forming at least one center section, a top section and a bottom section;

(b) means for securing said top section and said bottom section to each other for forming a luggage unit of a first size and means for securing said top section to each one side of said center section and said bottom section to the other side of said center section for forming a luggage unit of a second size larger than said first size; means for collapsing and fitting said center section into said secured top section and bottom section after said luggage unit of a first size is formed for carrying and storing said collapsed center section in said luggage unit of smaller size; and a housing for wheels mounted in said bottom section for enabling said luggage to be rolled along a surface;

(c) said center section and said bottom sections having a frame construction such that said frame of said center section adjoins said frame of said top and bottom sections by means of latches on said inner frame, interconnecting locks on said hard molded frame, and slide fasteners on said flexible, compliant material.

2. An article of luggage according to claim 1, wherein said hard, durable frame is composed of acrylonitrile-butadiene-styrene plastic.

3. An article of luggage according to claim 1, wherein said flexible, compliant material is composed of woven ballistic nylon.

4. An article of luggage according to claim 1, wherein said durable, harder inner frame is composed of magnesium.

5. An article of luggage according to claim 1, in which said center section can be removed from connections to said top and bottom sections, and said top and bottom sections may be secured together by means of said latches on said hard inner frame, an interconnecting lock arrangement on said hard molded frame, and slide fasteners on said flexible, compliant material.

6. An article of luggage according to claim 1 wherein said housing for wheels includes a wheel housing, at the base of said luggage opposite a handle, and disk shaped wheels that rotate around an axle where at least one of said axle and an axle hole in the wheel for said axle have at least a surface of a friction reducing material.

* * * * *